United States Patent [19]

Olmsted et al.

[11] Patent Number: 4,483,717

[45] Date of Patent: Nov. 20, 1984

[54] METHOD OF REMOVING ADSORBENT CONTAMINANTS FROM ELECTRICAL APPARATUS

[76] Inventors: John H. Olmsted, 16116 W. El Dorado Dr., New Berlin, Wis. 53151; Gary F. Lapp, 5576 Sonoma Dr., Pleasanton, Calif. 94566; Jerry Tappa, 1510 De Soto Way, Livermore, Calif. 94550

[21] Appl. No.: 309,917

[22] Filed: Oct. 8, 1981

[51] Int. Cl.[3] ..... B08B 7/04; B08B 5/00

[52] U.S. Cl. ..... 134/12; 134/11; 134/22.1; 134/22.19; 134/31; 141/48; 141/92

[58] Field of Search ..... 134/11, 12, 22.19, 31, 134/22.1; 141/48, 92

[56] References Cited

U.S. PATENT DOCUMENTS

| | | | |
|---|---|---|---|
| 3,733,218 | 5/1973 | Begun | 134/31 |
| 3,957,531 | 5/1976 | Tipping et al. | 134/11 |
| 4,425,949 | 1/1984 | Rowe, Jr. | 134/22.1 X |

OTHER PUBLICATIONS

Chemical Abstracts, vol. 96 (2), 1982, CA 9232s "Method of Destruction of PCB Contaminants in Oil."

Chemical Abstracts, vol. 99 (10), 1983, CA 73642q "Removing PCB from Oil."

Hutzinger et al., "*The Chemistry of PCBs*", CRC Press, Cleveland, Ohio, 1974, pp. 7–8, 14 and 15.

Kirk–Othmer, "*Encyclopedia of Chemical Technology*", John Wiley and Sons, N.Y., vol. 15, pp. 298–299 (3rd Edition).

Olmsted, "Transformer Askarel Removal to an EPA Clean Level", Conf. Res. of IAS Annual Mtg., Sep. 30–Oct. 5, 1979, pp. 1053–1055.

Parrish et al., "An Update on the Use, Labeling and Handling of Disposal of PCBs", Conf. Rec. of Annual Pulp Paper Ind. Tech. Conf. May, 1981, pp. 15–24.

*Primary Examiner*—S. Leon Bashore
*Assistant Examiner*—K. M. Hastings

[57] ABSTRACT

A novel process for the removal of Polychlorinated Biphenyls (PCBs) and other adsorbed material from electrical apparatus to limit residual contamination to be less than a predetermined level; the process includes the steps for removal of the bulk fluid, subsequent solvent wash, repeated contact with penetrating solvent vapor, and cooling solvent soaks, with continuous solvent recovery.

10 Claims, No Drawings

METHOD OF REMOVING ADSORBENT CONTAMINANTS FROM ELECTRICAL APPARATUS

BACKGROUND OF THE INVENTION

The subject invention relates to electrical apparatus, such as transformers and capacitors, which include a liquid dielectric fluid and a porous construction in part. Such apparatus is characterized by the adsorbtion of the liquid into the pores of structual support media, thereby rendering difficulty in the complete removal of said liquid.

For many years Polychlorinated Biphenyls have been used as an insulation fluid in the electrical apparatus industry as a safe fire resistant material. In the late 60's and early 70's it was discovered that Polychlorinated Biphenyls were an environmetal contaminant and their use was discontinued, however, by that time many pieces of electrical apparatus had been built using the Polychlorinated Biphenyls as an insulation media.

A primary use of Polychlorinated Biphenyl is in electrical transformers and electrical capacitors. This invention is in relation to the clean up and removal of the Polychlorinated Biphenyls from the apparatus and the eventual reclassification of the apparatus as non-Polychlorinated Biphenyl equipment. For reclassification it is necessary that tests demonstrate a contamination of less than 50 ppm of Polychlorinated Biphenyl after three months of operation after the completion process.

The transformers which are contaminated with Polychlorinated Biphenyls all have a major similarity in that they contain the cellulosic material installation usually of a paper wrap on the wire, comprising the core of the transformer. Included in the transformer may be wooden structures acting as insulators. Because of these two major items, the transformer acts as a sponge and Polychlorinated Biphenyls are impregnated into these materials. They are contained in such a manner that a single wash will not remove them, and that over a period of time the Polychlorinated Biphenyls will leach out of the cellulosic material and come to an equilibrium level in the transformer even if it had been filled with clean non-Polychlorinated Biphenyl oil.

A similar problem is encountered in the disposal of transformers and capacitors which are impregnated with Polychlorinated Biphenyls or Polychlorinated Biphenyl contaminated liquids. Regulations imposed by the United States Environmental Protection Agency prohibit the recovery and recycling of the equipment and the materials contained therein unless the equipment can be certified as non-Polychlorinated Biphenyl under those regulations.

Several methods are used or have been proposed for the cleanup of transformers. There are complete flushings with several classes of fluid thereby generating large volumes of Polychlorinated Biphenyl contaminated or Polychlorinated Biphenyl material by U.S. Environmental Protection Agency definition.

The problem with prior methods is that they either generate a very large volume of contaminated fluid, with more than 500 ppm of Polychlorinated Biphenyl, or that they require long periods of time to successfully complete.

SUMMARY OF INVENTION

The present invention relates to a process for the decontamination of liquid-filled electric apparatus, by the unique application of liquid and vapor phase solvents, utilizing conventional apparatus in a sequence which is dependent upon the characteristics of the apparatus to be cleaned and the solvents utilized. The methods of this invention overcome the time constraint which the resistance to leaching from the porous media and diffusion through the bulk liquid have imposed on all previous methodologies. Of particular importance to the success of this methodology is the alternate penetration of the porous media with solvent vapors which condense in situ within the liquid contaminant contained within the pores and the flushing of the media surfaces with liquid solvent which simultaneously washes those surfaces of the loaded solvent vapor condensate and cools the media to promote additional condensation in the next cycle.

DESCRIPTION OF INVENTION

One preferred embodiment of the present invention can be understood by its application to the draining and decontamination of electrical power transformers which have been previously insulated with Polychlorinated Biphenyls. It will be understood that other liquid materials which are often found accompanying Polychlorinated Biphenyls in power transformers, such as chlorinated benzene and conventional hydrocarbon oils, will be removed by the process of this invention along with the Polychlorinated Biphenyls without discrimination.

In accordance with the methods and processes of this invention, the transformer is first drained and allowed to stand for a period of time so all surface Polychlorinated Biphenyls can drip down and can be drained from the transformer case. The transformer is then washed with an amount of solvent of approximately three percent of its volume to remove any major gross puddles of Polychlorinated Biphenyls. The liquid solvent is dispersed throughout the case to flush out radiators etc. This solvent is then removed from the transformer and stored for further processing at the site using the vapor generator.

At this point the transformer has been processed in the manner which is normal to the industry in preparation for refilling with a non-Polychlorinated liquid. Bulk liquid has been drained and significant pools have been diluted so that the residual available for contaminating the new fluid amounts to between four and eight percent of the total liquid capacity of the transformer.

The next step in the process of this invention is to add into the transformer case an amount of liquid solvent equal to approximately 10% of the original volume. This solvent in then circulated by pumping through an external pump and back into the transformer case through a spray head which is configured to direct a gentle stream onto the surfaces of the core and coil assembly and onto the walls of the transformer case and radiator sub-assemblies. Recirculation through the spray nozzles is continued until the liquid solvent has passed through the nozzles on an average of 3 times. The recirculation is then ceased, the bulk of the solvent is drained from the transformer, and the internal surfaces are allowed to drip for approximately ½ hour before the draining is complete. This rinse cycle is repeated two more times, for a total of three spray-rinse cycles. In each case the spent solvent is stored for further processing at the site using the vapor generator. At this point, the transformer may be expected to contain a residual contamination with Polychlorinated Biphenyls of between one half percent and three percent of its original volume. These materials are all contained in the porous structure and are not readily available by continued liquid processing. The transformer is physically clean on all of its readily available surfaces but the pregnated Polychlorinated Biphenyls are available to leach into the bulk oil after refilling over a period of months, resulting in a contamination level that is unexceptable to the authorities.

The method of this invention continues with the closing of the transformer and the connection of the vapor generator to the transformer case by a large vapor transmission line at the top and a liquid return line at the base of the transformer. Superheated solvent vapor is pumped into the transformer from the vapor generator. This vapor then condenses on the surfaces and in the pores of the cellulosic material which insulates and supports the core and coil assembly. As the exposed surfaces heat condensation slows down and ceases on those surfaces. Continued solvent circulation is limited to the condensation which takes place within the porous media and on the outer cool surfaces of the transformer case. It has been found that heating and insulating of the transformer case will reduce the flow rate requirements on the vapor generator with little negative impact upon the utility of the method. The condensed vapors collect in the bottom of the transformer case from which they are pumped back into the vapor generator. This vapor generator affectively separates the solvent from the Polychlorinated biphenyls and other materials by distillation.

It is a teaching of this invention that it is necessary to purge air from the transformer-vapor generator system to allow vapor pressures which are sufficient to force significant entry of uncondensed material into the porous media. This is accomplished by venting the transformer through a chilled condenser which affectively recovers all of the solvent which is carried with the air being purged from the system, maintaining the purge until the volume of solvent vapors being condensed corresponds to four times the system volume, has been found to be sufficient. Those schooled in the arts of transformer construction and maintenance will recognize the necessity of this purge process as being a reflection of the pressure-withstand capability of liquid filled transformers.

Clean solvent vapors are continuously added to the transformer and contaminated liquid solvent removed and returned to the vapor generator until the temperature within the porous media has risen to where condensation rates are no longer practicable. It is a teaching of this invention that this condition is easily monitored by the use of a thermocouple temperature indication system where the sensing thermocouple is installed within a simulated insulation package that is placed within the transformer case. This simulated insulation package is constructed from a block of wood and conventional craft insulating paper which is used in conventional transformers constructions. The thermocouple is installed between the wood and the layers of paper. Such an assembly can be visualized as being approximately four inches square with wood thickness of one inch and total paper lamination thickness of ½ inch. This assembly is soaked in the insulating oil which is to be used when refilling the transformer, prior to installing it within the case. When the temperature indicated for that monitoring thermocouple is approximately 2° fahrenheit (1° celsius) below the temperature of the incoming solvent vapors, the process should be interrupted.

The core and coil assembly and other transformer surfaces are then cooled by repeating one of the above rinse cycles using room temperature solvent liquid. After draining this liquid and returning it to the vapor generator, the vapor process can be repeated for one or more additional cycles. The number of vapor and rinsing cycles which are used is strictly a function of the desired ultimate residual contamination level. Approximately one order of magnitude reduction in the residual contamination level will be achieved for each vapor and liquid cycle which is accomplished.

It is essential to the success of the method of this invention that following the last vapor process cycle the transformer case and the core and coil assemblies be warmed throughout to a temperature well above the atmospheric boiling point of the solvent used. During this period the vapor generator is disconnected from the transformer case and the case is vented through the condenser referred to earlier. This step is necessitated by the potential for adverse impact upon the operating characteristics of the insulating liquid to be used by the residual solvent which might otherwise remain within the transformer.

The transformer should then be refilled with the desired insulating liquid. The transformer should be hot and vented through the condenser during the time that it is being refilled with insulating liquid which is also heated to the same temperature. Although it is not a part of the subject invention, where the transformer design will permit it, it is often desirable to partially evacuate the transformer case prior to and during this refilling operation.

It has been found that characteristics of the solvents used are important to the selection of processing intervals and the ultimate success of the methodology. In addition to the obvious requirements of miscibility with Polychlorinated Biphenyls and the desired replacement liquid, the solvent should have an atmospheric boiling point between 100° and 250° fahrenheit, low viscosity and surface tension as a liquid, and minimal solvent capability with respect to the materials of construction. In a preferred embodiment of this invention, the solvent is trichlorotriflouroethane.

It has been found that the addition of a simple liquid rinse using a quantity of the intended replacement liquid equal to approximately 10% of the transformer volume is a desirable additional processing step whenever complete liquid removal from the bottom of the transformer case cannot be assured. This step should be inserted into the processing sequence immediately prior to the final refilling of the transformer.

Although additional complications are entailed due to the dielectric characteristics of the material, low molecular weight alcohols such as methanol and ethanol can be used with equal success with this method. Caution should be exercised when using these solvents however, because of their flamability characteristics. Evidence to date indicates that, where flamability considerations are not critical, low molecular weight saturated hydrocarbons such as octane and decane can be used with equal success.

The embodiments of this invention in which exclusive property and privilege are claimed are as follows:

1. The process for the removal of polychlorinated biphenyl from electrical apparatus comprising:

contacting the apparatus with a solvent in a combination of liquid and vapor contacting cycles wherein said vapor condenses in-situ on the apparatus; said solvent being selected to enable its recovery and reuse by distillation from the polychlorinated biphenyls which it accumulates; and after the last vapor cycle, heating the apparatus to a temperature above the atmospheric boiling point of the solvent.

2. The process according to claim 1 wherein the solvent is trichlorotriflouroethane.

3. The process according to claim 1 wherein the solvent is selected to be a saturated hydrocarbon having an atmospheric boiling point between 100° and 300° fahrenheit.

4. The process according to claim 1 where the solvent is selected from alcohols have an atmospheric boiling point between 100° and 300° fahrenheit.

5. The process according to claim 1 where the solvent is selected from chlorinated hydrocarbon liquids to have an atmospheric boiling point between 100° and 300° fahrenheit.

6. The process according to claim 1 wherein the vapor contacting cycle is controlled by the utilization of a simulated insulation model contained within the equipment case.

7. The process according to claim 1 wherein purging of residual air accompanies the vapor contacting cycle and is accomplished by the utilization of a densing ventilation system.

8. The process according to claim 7 wherein the solvent is trichloroltriflouroethane.

9. The process according to claim 8 as it applies to the decontamination of liquid filled transformers which contained polychlorinated biphenyls.

10. The process according to claim 8 applied to a closed storage vessel of conventional design which is filled with discarded solid materials, said materials contaminated with polychlorinated biphenyls.

* * * * *